US010495283B2

(12) United States Patent
Tuley et al.

(10) Patent No.: US 10,495,283 B2
(45) Date of Patent: Dec. 3, 2019

(54) LAMP

(71) Applicant: EUROPEAN THERMODYNAMICS LTD., Kibworth, Leicester Leicestershire (GB)

(72) Inventors: Richard Tuley, Kibworth (GB); Mark Jones, Kibworth (GB); Nick Porter, Kibworth (GB)

(73) Assignee: EUROPEAN THERMODYNAMICS LTD. (GB)

( * ) Notice: Subject to any disclaimer, the term of this patent is extended or adjusted under 35 U.S.C. 154(b) by 12 days.

(21) Appl. No.: 15/579,670

(22) PCT Filed: May 26, 2016

(86) PCT No.: PCT/GB2016/051521
§ 371 (c)(1),
(2) Date: Dec. 5, 2017

(87) PCT Pub. No.: WO2016/193674
PCT Pub. Date: Dec. 8, 2016

(65) Prior Publication Data

US 2018/0156413 A1 Jun. 7, 2018

(30) Foreign Application Priority Data

Jun. 5, 2015 (GB) ..... 1509767.8

(51) Int. Cl.
*F21V 29/57* (2015.01)
*F21S 45/60* (2018.01)
(Continued)

(52) U.S. Cl.
CPC ..... *F21S 45/60* (2018.01); *F21S 45/435* (2018.01); *F21S 45/46* (2018.01); *F21S 45/50* (2018.01);
(Continued)

(58) Field of Classification Search
CPC .. F21S 45/60; F21S 45/46; F21S 45/50; F21S 45/435; F21V 29/503; F21V 29/57;
(Continued)

(56) References Cited

U.S. PATENT DOCUMENTS 8,864,345 B2 * 10/2014 Bakk ..... F21K 9/00 362/311.02
2012/0201031 A1 * 8/2012 Marley ..... G02B 27/0006 362/294

FOREIGN PATENT DOCUMENTS

DE 102007057056 A1 5/2009
DE 102012010871 A1 1/2013
(Continued)

OTHER PUBLICATIONS

International Search Report for International Application No. PCT/GB 2016/051521. Date of Completion of International Search: Jul. 28, 2016. International Search Report dated: Nov. 3, 2016. Authorized Office Wim Amerongen.

*Primary Examiner* — Jimmy T Vu
(74) *Attorney, Agent, or Firm* — Vorys, Sater, Seymour and Pease LLP

(57) ABSTRACT

A lamp (100) comprising: a housing (110) having a transparent portion (101); a light source (102) disposed at least partially within the housing (110), wherein the light source (102) is configured to emit light, in use, through the transparent portion (101) of the housing (110); and a heat transfer unit (103) disposed at least partially within the housing (110), the heat transfer unit (103) comprising a heater (105) and a fluid circulator (106), wherein the heat transfer unit (103) is operable in a first mode and a second mode; wherein in the first mode, the heater (105) is turned on, thereby heating a thermal transfer fluid contained within the housing (110), and the fluid circulator (106) is operated to circulate the thermal transfer fluid such that heat is transferred to the
(Continued)

transparent portion (101) of the housing (110); and in the second mode, the heater (105) is turned off, and the fluid circulator (106) is operated to circulate the thermal transfer fluid contained within the housing (110) such that heat is transferred away from the light source (102) to the transparent portion (101) of the housing.

18 Claims, 11 Drawing Sheets

(51) Int. Cl.

| | |
|---|---|
| ***F21V 31/03*** | (2006.01) |
| ***F21V 29/90*** | (2015.01) |
| ***F21S 45/50*** | (2018.01) |
| ***F21V 29/503*** | (2015.01) |
| ***F21V 29/58*** | (2015.01) |
| ***F21V 29/61*** | (2015.01) |
| ***F21V 29/67*** | (2015.01) |
| ***F21S 45/46*** | (2018.01) |
| ***F21S 45/435*** | (2018.01) |
| ***F21V 23/04*** | (2006.01) |
| *F21Y 101/00* | (2016.01) |
| *F21V 29/71* | (2015.01) |

(52) U.S. Cl.
CPC ..... *F21V 23/0442* (2013.01); *F21V 29/503* (2015.01); *F21V 29/57* (2015.01); *F21V 29/59* (2015.01); *F21V 29/61* (2015.01); *F21V 29/67* (2015.01); *F21V 29/90* (2015.01); *F21V 31/03* (2013.01); *F21V 29/71* (2015.01); *F21Y 2101/00* (2013.01)

(58) Field of Classification Search
CPC ..... F21V 29/59; F21V 29/61; F21V 29/67; F21V 29/90; F21V 23/0442; F21V 31/03; F21V 29/71; F21Y 2101/00
USPC .... 315/77–82, 151, 152, 291, 294, 307, 308
See application file for complete search history.

(56) References Cited

FOREIGN PATENT DOCUMENTS

| | | | |
|---|---|---|---|
| DE | 102011084114 | A1 | 4/2013 |
| DE | 102011089945 | A1 | 6/2013 |
| DE | 102014009628 | A1 | 8/2015 |
| DE | 102014102921 | A1 | 9/2015 |
| WO | 2013066379 | A2 | 5/2009 |
| WO | 2013102820 | A1 | 7/2013 |
| WO | 2015197146 | A1 | 12/2015 |

* cited by examiner

LAMP

The present invention relates to a lamp, for example, but not exclusively, a vehicle headlamp. In particular, the present invention relates to a lamp comprising a heat transfer unit and a method of operation of such a lamp comprising a heat transfer unit. It is well known that a light source within a lamp can heat up, and potentially overheat, during use, which can reduce the lifetime of the light source and/or its efficiency (e.g. by adversely affecting the colour and/or intensity of light emitted by the light source). This is even a problem for light sources (e.g. light emitting diodes (LEDs)) which produce less waste heat than more traditional light sources, such as filament or halogen bulbs. Hence, an undesired increase in the temperature of an LED and/or the temperature of the LED control and/or driver electronics can be detrimental to the light output quality and/or efficiency of the LED.

Vehicle headlamps comprising LEDs are becoming increasingly common. LED headlamps have advantages including being relatively small, reliable and energy efficient and may also be preferred for aesthetic reasons. However, vehicle headlamps need to emit, in use, reliable, high quality light on demand to provide a driver with consistently good low-light, e.g. night-time, visibility, and to provide other road users with a clear indication of the presence of the vehicle. Thus, if the quality and/or consistency of the light emitted by an LED headlamp is compromised at any time in use, then road and vehicle safety may be affected.

Similar considerations may apply to applications other than vehicle headlamps.

Thus, it may be beneficial for an LED (or other light source) within a lamp to be cooled during use.

It is known to use a fan and/or a heat sink to cool a light source within a lamp. An example of such a cooling system is disclosed in U.S. Pat. No. 8,047,695. The electronics controlling an LED light source can similarly be cooled using a fan and/or heat sink, as disclosed in US20110310631A.

The cover or lenses of a lamp may also suffer from frost or condensation on the inside or outside of the cover and/or lens, thereby reducing the light output of the lamp. This is particularly a problem for lamps operated outside (e.g. external building security lights, or vehicle headlamps) and/or in damp or cold environments.

As is known in the art, such frost and/or condensation can be reduced by heating the lamp, e.g. vehicle headlamp, cover or lenses. Most commonly, the cover or lens can be heated directly by using a resistive heater on or in the cover or lens, with a separate heat sink and/or fan used to cool the light source. An example of such a known system is disclosed in U.S. Pat. No. 8,899,803 B2.

In other known examples, the heating element may be incorporated into a fan assembly inside the lamp for defrosting and dehumidification of the cover of a lamp, as proposed in DE102011084114 in relation to a vehicle headlamp.

In other systems, the waste heat generated by the light source and/or electronics may be used to heat the lamp cover. The waste heat from an LED driver may be directly coupled to the cover of a lamp by thermal conduction using a material with good thermal conductivity, as in U.S. Pat. No. 8,314,559B.

Alternatively, US 20110310631 discloses the use of a fan to cool a vehicle lamp's light source and electronics. The waste heat from the electronics can then be used to heat air in the bulb chamber to reduce any condensation on the cover.

In a first aspect of the invention, there is provided a lamp comprising: a housing having a transparent portion; a light source disposed at least partially within the housing, wherein the light source is configured to emit light, in use, through the transparent portion of the housing; and a heat transfer unit disposed at least partially within the housing, the heat transfer unit comprising a heater and a fluid circulator, wherein the heat transfer unit is operable in a first mode and a second mode; wherein

- in the first mode, the heater is turned on, thereby heating a thermal transfer fluid contained within the housing, and the fluid circulator is operated to circulate the thermal transfer fluid such that heat is transferred to the transparent portion of the housing; and
- in the second mode, the heater is turned off, and the fluid circulator is operated to circulate the thermal transfer fluid contained within the housing such that heat is transferred away from the light source to the transparent portion of the housing.

The light source may include a light emitter and any electronics coupled to the light emitter (e.g. a power supply, resistors etc.). The electronics may be disposed at least partially within the housing, for example on a circuit board. In the second mode of operation, the fluid circulator may be configured to transfer heat away from the electronics and/or the light emitter.

Optionally, one or more heat sinks may be coupled to the light source or a part thereof (e.g. the light emitter and/or electronics) to transfer any waste heat to the thermal transfer fluid.

In some embodiments, the light source may be operable to emit visible light, and/or UV radiation, and/or infrared radiation. In an embodiment, the wavelength of the light emitted by the light source may be variable.

The transparent portion of the housing may therefore allow light of different wavelengths to pass through, dependent on the type of light source used. The transparent portion may comprise one or more lenses. For example, the transparent portion may comprise a glass or plastic (e.g. polyethylene or polycarbonate) window transparent to visible light. In some embodiments, the entire housing may be transparent to one or more wavelengths of light.

The light source may comprise one or more light emitting diodes (LEDs). For example, the light source may comprise an array of LEDs. The number of LEDs turned on at a given time, and/or the brightness of the LEDs may be adjustable.

For example, the light source may comprise separate settings corresponding to the full-beam, dimmer and fog-light settings required in a vehicle headlamp.

Optionally, the thermal transfer fluid may be a gas or a liquid, such as air, and/or water, and/or polymeric fluids. In some embodiments, the thermal transfer fluid may be fully or partially encapsulated in a sealed fluid communication path. Optionally, the thermal transfer fluid may be free to flow within the housing.

The thermal transfer fluid may be optically transparent or clear. Optionally, the thermal transfer fluid may be disposed out of the optical path between the light source and the transparent portion of the housing.

Air may be particularly preferred as the thermal transfer fluid, since it is transparent, as well as being relatively cheap and readily available. Furthermore, if air is used as the thermal transfer fluid, then the housing may not need to be sealed, since in many applications, there typically would be no health and safety risk associated with air passing from the housing into the external environment.

In an embodiment, there may be fluid communication between the inside of the housing and the external environment. Advantageously, this may allow for pressure equalisation to take place between the inside of the housing and the external environment. Pressure equalisation may help to minimise the stresses experienced, in use, by the components of the lamp (e.g. the housing, the transparent portion, the light source, the heat transfer unit).

Conveniently, the heat transfer unit may be a single, compact unit.

Advantageously, the heat transfer unit of the present invention is capable of cooling the light source (e.g. light emitter and/or electronics) and defrosting and/or dehumidifying the transparent portion of the housing by operating in the two different modes.

Beneficially, this may reduce additional weight in the lamp and/or manufacturing cost compared to known systems which use separate heating and cooling apparatus. Typically, these known systems either require two separate components to provide cooling of the light source and heating of the lamp cover or lenses, or require the light source and/or electronics to have warmed up to a sufficient temperature to be able to generate enough heat to warm the lamp front cover or lens.

In contrast, the present invention provides a lamp, which comprises a single heat transfer unit that can provide both cooling of the light source, and heating of the lamp cover whenever required.

This may be particularly advantageous in the case of a vehicle headlamp. When it is cold, say on a winter's night, frost may build up on the lamp front cover or lens. The presence of frost on the lamp front cover or lens may reduce the brightness and/or size of the beam of light emitted by the headlamp. When a driver initially starts the vehicle and turns on the headlamp, the light source within the headlamp, particularly if the light source comprises one or more LEDs, will not give out sufficient waste heat that can be used to defrost the lamp front cover. By operating the heater at this time, the lamp front cover or lens may be defrosted. However, after a while, the light source may be giving out sufficient waste heat to be useful in keeping the lamp front cover or lens free from frost.

In the first mode, the heat transfer unit only defrosts and/or dehumidifies at least the transparent portion of the lamp housing. In the first mode, the heater heats the thermal transfer fluid and the heated thermal transfer fluid is circulated by the fluid circulator such that heat is transferred to the transparent portion of the housing.

In the second mode, the heat transfer unit cools the light source (e.g. light emitter(s) and/or electronics), whilst providing some heating to at least the transparent portion of the housing. In the second mode, the heater is turned off. Waste heat is transferred from the light source to the thermal transfer fluid. The fluid circulator then causes circulation of the thermal transfer fluid away from the light source. The waste heat carried by the thermal transfer fluid may then be transferred to the transparent portion of the housing.

The heat transfer unit can fulfil the required functions of both of these two modes as it has been realised in this invention that these modes are required at different times during the operation of the lamp. For example, during the period immediately after the lamp is turned on, the light source (e.g. light emitter and/or electronics) has not yet significantly warmed up, so does not require cooling and/or cannot provide sufficient waste heat to heat the transparent portion of the housing. However, the transparent portion of the housing may be cold and so may need heating, e.g. to remove frost and/or condensation, and so the heat transfer unit can be operated in the first mode. Once the light source has heated up, the heat transfer unit can switch to the second mode of operation to reduce the temperature of the light source and provide heating of the transparent portion of the housing.

In some embodiments, the mode of operation of the heat transfer unit may be selected by a user. For example, a user may press a button, or a switch, or pull a lever to select the first mode of operation if the user notices frost and/or condensation building on the transparent portion of the housing.

Optionally, the lamp may further comprise at least one sensor operable to detect one or more of: the amount of time the lamp has been switched on; the ambient temperature external to the lamp; the temperature within the housing; the temperature of the light source within the housing; and/or the amount of moisture on the transparent portion of the housing.

In some embodiments, multiple sensors may be provided. One or more sensors may be disposed outside of the housing of the lamp, or coupled to the housing.

Optionally, the heat transfer unit may be operated in the first mode of operation when: the lamp is initially turned on; and/or the ambient temperature external to the lamp is below a predetermined threshold; and/or the amount of moisture on the transparent portion of the housing is above a predetermined threshold.

Optionally, the heat transfer unit may be operated in the second mode of operation when: the lamp has been turned on for a set amount of time; and/or the temperature of the light source within the housing is above a predetermined threshold; and/or the ambient temperature external to the lamp is above a predetermined threshold; and/or the amount of moisture on the transparent portion of the housing is below a predetermined threshold.

The predetermined thresholds may be set and/or adjusted by the user. In some embodiments, the predetermined thresholds may be determined by a processor dependent, for example, on the application of the lamp (e.g. in a vehicle headlamp) and/or the type of light source.

In some embodiments, a processor may be configured to receive instructions from a user and/or the one or more sensors. The processor may output instructions to a controller. The controller may be configured to control the operation of the heat transfer unit. The processor and/or the controller may be disposed at least partially within the housing or external to the housing.

In some embodiments, the controller may be configured to control the mode of operation of the heat transfer unit, and/or the amount of heat output by the heater, and/or the speed at which the fluid circulator circulates the thermal transfer fluid. The controller may also be operable to control the output of the light source (e.g. the number of LEDs switched on and/or the brightness of the LEDs).

In the example of a vehicle headlamp, it is increasingly common for cars to indicate the external temperature and/or weather conditions on a visual display within the car. According to the present invention, this information may be transmitted to the processor which may then output instructions to the controller dependent upon this information.

Optionally, the fluid circulator may comprise one or more of a mechanically or electrically operated fan, pump or compressor. Multiple fluid circulators may be provided within the heat transfer unit.

In some embodiments, the heat transfer unit may be positioned out of the optical path between the light source and the transparent portion of the housing. This may be advantageous as no light will be blocked from exiting the lamp, thereby maximising the light output of the lamp. This may also provide an advantage over the prior art, as systems having a heater applied directly to the front cover of a lamp will likely block at least some light from exiting the lamp.

Optionally, the fluid circulator may be operable to circulate the thermal transfer fluid in two or more different directions. For instance, the fluid circulator may be operable to circulate the thermal transfer fluid in different directions when operating in the first and second modes. In an embodiment, the fluid circulator may comprise two or more fans, pumps or compressors configured to circulate the thermal transfer fluid in different directions when operating in the first or second modes.

In some embodiments, the direction of operation of the fluid circulator may be variable, e.g. reversible. For instance, the fluid circulator may comprise a single fan, pump or compressor wherein the direction of operation of the fan, pump or compressor is reversible. For example, the fluid circulator may comprise a fan, wherein the direction of rotation of the fan blades may be reversed by reversing the polarity of an electric current applied to the fan.

Optionally, the heater may comprise at least one resistance wire heating element. The or each resistance wire heating element may be directly coupled to the fluid circulator.

Additionally or alternatively, the heater may comprise a hot plate, a ceramic heating element, and/or an infrared bulb. The heater may comprise a heat exchanger, in which heat is transferred, in use, from a higher temperature fluid to the thermal transfer fluid within the housing.

In an embodiment, the heater may be spaced from the fluid circulator, within the heat transfer unit.

In an embodiment, the lamp may be a vehicle lamp, e.g. a road vehicle headlamp, indicator lamp, rear lamp, brake lamp or reverse lamp. The vehicle may be a road vehicle, an aircraft, a rail vehicle, or a maritime vessel such as a boat or a ship. The lamp may be a lamp for use inside or outdoors, e.g. a security lamp for a building, a street lamp, a lamp for guiding an aircraft (e.g. at an airport), a ship (e.g. at a harbour, or in a shipping lane, say a buoy or a lighthouse) or a road vehicle (e.g. traffic lights or illuminated signage).

In some embodiments, the vehicle lamp may comprise at least one sensor operable to measure the amount of time that the vehicle has been turned on (for example, the amount of time that the engine has been ignited/running).

Optionally, the heat transfer unit of the vehicle lamp may operate in the second mode when the vehicle has been turned on for a set amount of time.

Optionally, the lamp, e.g. vehicle lamp, may further comprise a controller operable to control the heat transfer unit. The controller may be an electronic controller. The controller may provide at least one output to the fluid circulator and/or heater, thereby providing control over at least one of the direction and/or speed of the fluid circulator and/or the heater power.

A second aspect of the invention provides a structure, e.g. a vehicle or a stationary structure, comprising, carrying or having associated therewith a lamp according to the first aspect of the invention. The vehicle may be a road vehicle such as a car, a bus or a lorry, a rail vehicle, an aircraft or a boat or ship or other maritime vessel.

The vehicle may be a car, motorcycle, bike, bus, train, plane, helicopter, boat, ship or tram etc.

The stationary structure may be on land, floating, at least partially submerged or airborne. The stationary structure may comprise a building or an item of infrastructure. For instance, the structure may comprise an offshore rig or platform.

Optionally, the vehicle may comprise at least one sensor operable to measure the amount of time that the vehicle has been turned on.

In some embodiments, the heat transfer unit may operate in the second mode when the vehicle has been turned on for a set amount of time. Optionally, the heat transfer unit may operate in the first mode when the vehicle is initially turned on.

A third aspect of the invention provides a kit of parts for assembly into a lamp according to the invention, the kit of parts comprising: a housing having a transparent portion; a light source disposable at least partially within the housing and configurable to emit light, in use, through the transparent portion of the housing; and a heat transfer unit disposable at least partially within the housing, the heat transfer unit comprising a heater and a fluid circulator, wherein the heat transfer unit is operable in a first mode and a second mode; wherein in the first mode, the heater is turned on, thereby heating a thermal transfer fluid contained within the housing, and the fluid circulator is operated to circulate the thermal transfer fluid such that heat is transferred to the transparent portion of the housing; and in the second mode, the heater is turned off, and the fluid circulator is operated to circulate the thermal transfer fluid contained within the housing such that heat is transferred away from the light source to the transparent portion of the housing.

Typically, the kit of parts may include instructions for assembling the lamp.

It is an advantage of the present invention that the heat transfer unit may be conveniently and inexpensively retrofitted into existing lamps to improve the performance of the lamp by providing improved temperature control within the lamp.

Moreover, a lamp comprising a fan to cool a light source within the lamp may be adapted by the addition of a heater to provide a lamp according to the invention.

Optionally, the kit of parts may further comprise a controller operable to control the heat transfer unit. The controller may be an electronic controller. The controller may provide at least one output to the fluid circulator and/or heater, thereby providing control over at least one of the direction and/or speed of the fluid circulator and/or the heater power.

A fourth aspect of the invention provides a kit of parts for assembly into a lamp according to the first aspect of the invention, the kit of parts comprising a heater and/or a fluid circulator.

A fifth aspect of the invention provides a heat transfer unit for use in a lamp, the lamp comprising a housing having a transparent portion and a light source disposed at least partially within the housing, wherein the light source is configured to emit light, in use, through the transparent portion of the housing, wherein the heat transfer unit is adapted to be disposable at least partially within the housing and the heat transfer unit comprises a heater and a fluid circulator, wherein the heat transfer unit is operable in a first mode and a second mode; wherein in the first mode, the heater is turned on, thereby heating a thermal transfer fluid contained within the housing, and the fluid circulator is operated to circulate the thermal transfer fluid such that heat is transferred to the transparent portion of the housing; and in the second mode, the heater is turned off, and the fluid circulator is operated to circulate the thermal transfer fluid contained within the housing such that heat is transferred away from the light source to the transparent portion of the housing.

Optionally, the heat transfer unit may further comprise a controller operable to control the heat transfer unit. The controller may be an electronic controller. The controller may provide at least one output to the fluid circulator and/or heater, thereby providing control over at least one of the direction and/or speed of the fluid circulator and/or the heater power.

The controller may be separate from the heat transfer unit. Alternatively, the controller may be integral to the heat transfer unit (e.g. provided in the housing of the heat transfer unit).

The controller may be in communication with the heat transfer unit via a data link, e.g. a wireless or wired data link.

A sixth aspect of the invention provides a method of manufacture of a lamp comprising:

providing a housing having a transparent portion;

disposing a light source at least partially within the housing and configuring the light source to emit light, in use, through the transparent portion of the housing;

disposing a heat transfer unit at least partially within the housing, the heat transfer unit comprising a heater and a fluid circulator, wherein the heat transfer unit is operable in a first mode and second mode; wherein in the first mode, the heater is turned on, thereby heating a thermal transfer fluid contained within the housing, and the fluid circulator is operated to circulate the thermal transfer fluid such that heat is transferred to the transparent portion of the housing; and in the second mode, the heater is turned off, and the fluid circulator is operated to circulate the thermal transfer fluid contained within the housing such that heat is transferred away from the light source to the transparent portion of the housing.

In a seventh aspect of the invention, there is provided a method of operating a lamp according to the first aspect of the invention, the method comprising:

operating the heat transfer unit in the first mode, whereby operating the heat transfer unit in the first mode comprises: turning on the heater; heating the thermal transfer fluid contained within the housing; circulating the thermal transfer fluid using the fluid circulator; and transferring heat from the thermal transfer fluid to the transparent portion of the housing; and subsequently operating the heat transfer unit in the second mode, whereby operating the heat transfer unit in the second mode comprises: transferring heat from the light source to the thermal transfer fluid; with the heater turned off, circulating the thermal transfer fluid away from the light source using the fluid circulator; and transferring heat from the thermal transfer fluid to the transparent portion of the housing.

The light source may include at least one light emitter and/or any electronics coupled to the light emitter(s). Optionally, the step of transferring heat from the light source to the thermal transfer fluid in the second mode may comprise transferring heat from the electronics to the thermal transfer fluid.

The method may further comprise the step of receiving instructions, e.g. user instructions, to select either the first mode or the second mode of operation of the heat transfer unit.

Optionally, the method may further comprise using at least one sensor to detect one or more of: the amount of time the lamp has been switched on; the ambient temperature external to the lamp; the temperature within the housing; the temperature of the light source within the housing; and/or the amount of moisture on the transparent portion of the housing.

Optionally, the method may comprise selecting to operate the heat transfer unit in the first mode when: the lamp is initially turned on; and/or the ambient temperature external to the lamp falls below a predetermined threshold; and/or the amount of moisture on the transparent portion of the housing is above a predetermined threshold.

The method may comprise selecting to operate the heat transfer unit in the second mode when: the lamp has been turned on for a set amount of time; and/or the temperature of the light source within the housing is above a predetermined threshold; and/or the ambient temperature external to the lamp is above a predetermined threshold; and/or the amount of moisture on the transparent portion of the housing falls below a predetermined threshold.

In some embodiments, the method may comprise receiving instructions from a user and/or the one or more sensors at a processor, and outputting instructions from the processor to a controller configured to control the mode of operation of the heat transfer unit.

Optionally, the method may comprise the step of reversing the direction of circulation of the thermal transfer fluid when switching between the first and second modes of operation.

The step of reversing the direction of circulation of the thermal transfer fluid may comprise reversing the polarity of an electric current applied to a fan.

Embodiments of the invention will now be described, by way of example only, with reference to the accompanying drawings, in which.

Figure 1:
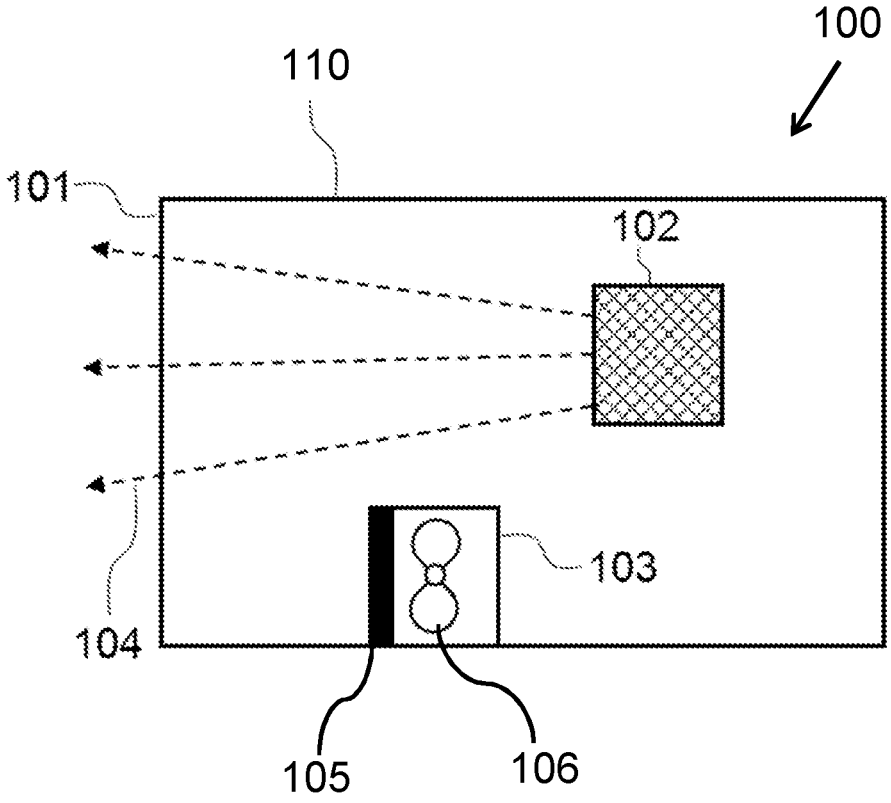
FIG. 1 is a schematic illustration of a lamp according to an embodiment of the invention.

A schematic illustration of a lamp 100 according to an embodiment of the invention is shown in FIG. 1. In some embodiments, the lamp 100 may comprise a vehicle headlamp.

The lamp 100 comprises a heat transfer unit 103. The heat transfer unit 103 comprises a fan 106 and a heater 105. In some embodiments, heat transfer unit 103 may comprise a pump and/or a compressor instead of, or in addition to, a fan.

The lamp 100 comprises a housing 110 having a transparent portion 101. The housing contains a thermal transfer fluid which, in the example shown in FIG. 1, is air. The housing 110 separates at least partially external air from the air inside the lamp 100.

In some embodiments, the housing 110 may be configured to provide fluid communication between the inside of the housing and the external environment. Thus, air may move between the external environment and the inside of the housing, thereby allowing for pressure equalisation. For example, the housing 110 may comprise one or more fluid flow channels between the interior and exterior of the housing 110.

The lamp 100 further comprises a light source 102. The light source 102 includes a light emitter and/or any electronics coupled to the light emitter. The light emitter can emit visible light 104, which may pass, in use, through the transparent portion 101 of the housing 110. In this embodiment, the transparent portion 101 is transparent (i.e. transmits) visible light. The heat transfer unit 103 is positioned such that it does not obstruct the light emitted 104 from the light source 102.

Figure 2:
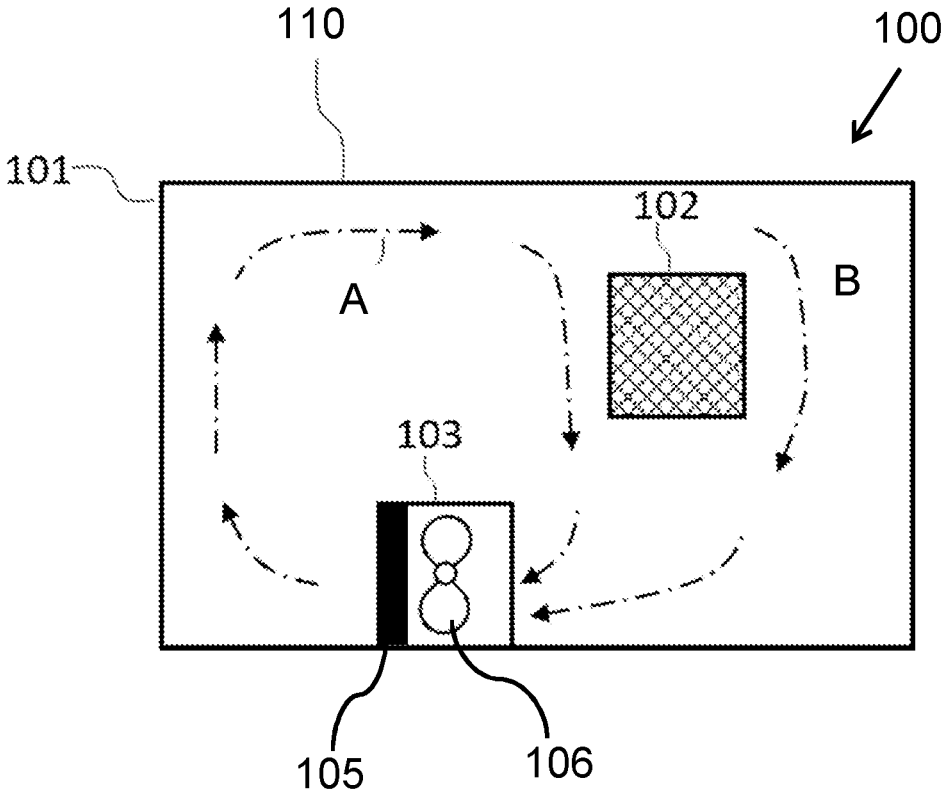
FIG. 2 is a schematic illustration of an example air flow in the lamp of FIG. 1.

A schematic illustration of a possible air flow direction in FIG. 1 when the fan 106 is operating is shown in FIG. 2.

The fan 106 may cause air (or whichever thermal transfer fluid is contained within the housing 110) to circulate along paths A or B within the lamp 100.

Along path A or path B, the air is directed from the heat transfer unit 103, to the transparent portion 101 of the housing, past (or around) the light source 102 and back to the fan 106.

In the first mode of operation, the heat transfer unit 103 is required to heat the transparent portion 101 of the housing to reduce or prevent condensation or frost disposed on the transparent portion 101. Both the heater 105 and the fan 106 in the heat transfer unit 103 are turned on in this mode.

Figure 3:
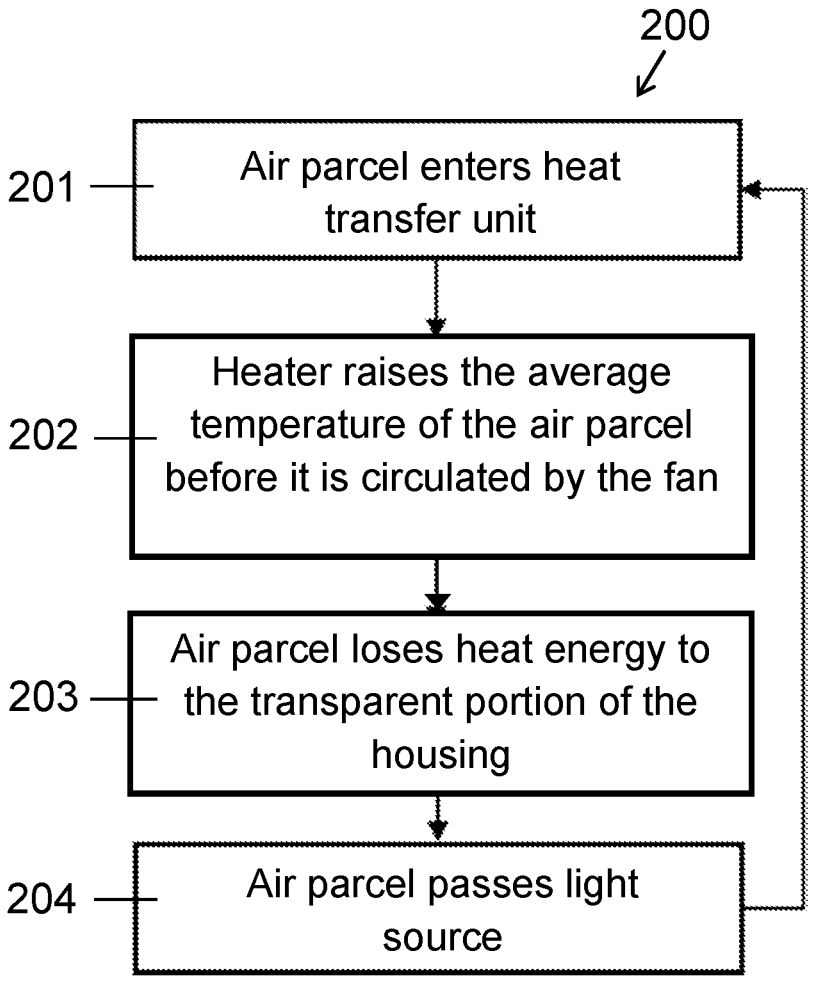
FIG. 3 is a flow chart illustrating the heat exchange process in the lamp according to the example in FIG. 2, with the heat transfer unit operating in the first mode.

FIG. 3 is a flow chart illustrating the heat exchange process 200 in the lamp 100 of FIG. 1 when the heat transfer unit 103 is operating in the first mode, wherein an air parcel is defined as a small volume of air.

An air parcel inside the lamp 100 enters the heat transfer unit 103, step 201. The air parcel then passes through the heater 105, which is turned on. The heater 105 raises the average temperature of the air parcel passing through the heat transfer unit 103, step 202.

The fan 106, which is turned on, then circulates the heated air parcel out of the heat transfer unit 103 towards the transparent portion 101 of the housing. The heated air parcel then loses heat energy to the transparent portion 101 of the housing, step 203.

The transparent portion 101 is therefore heated, reducing or preventing any condensation or frost, and the temperature of the air packet is lowered. The air parcel then passes the light source 102, step 204, before returning to heat transfer unit 103.

Other heat flows between the housing 110 and an air parcel, and/or the light source (including the light emitter and/or electronics coupled to the light emitter) 102 and an air parcel are also possible.

In the second mode of operation, the heat transfer unit 103 is required to cool at least one of the light emitter and electronics (i.e. the light source 102), which can improve their performance (e.g. intensity, brightness, efficiency) and/or their lifetime. In the second mode the heater 105 is switched off while the fan 106 is switched on. An air parcel inside the lamp may undergo the heat exchange process as illustrated in FIG. 4.

Figure 4:
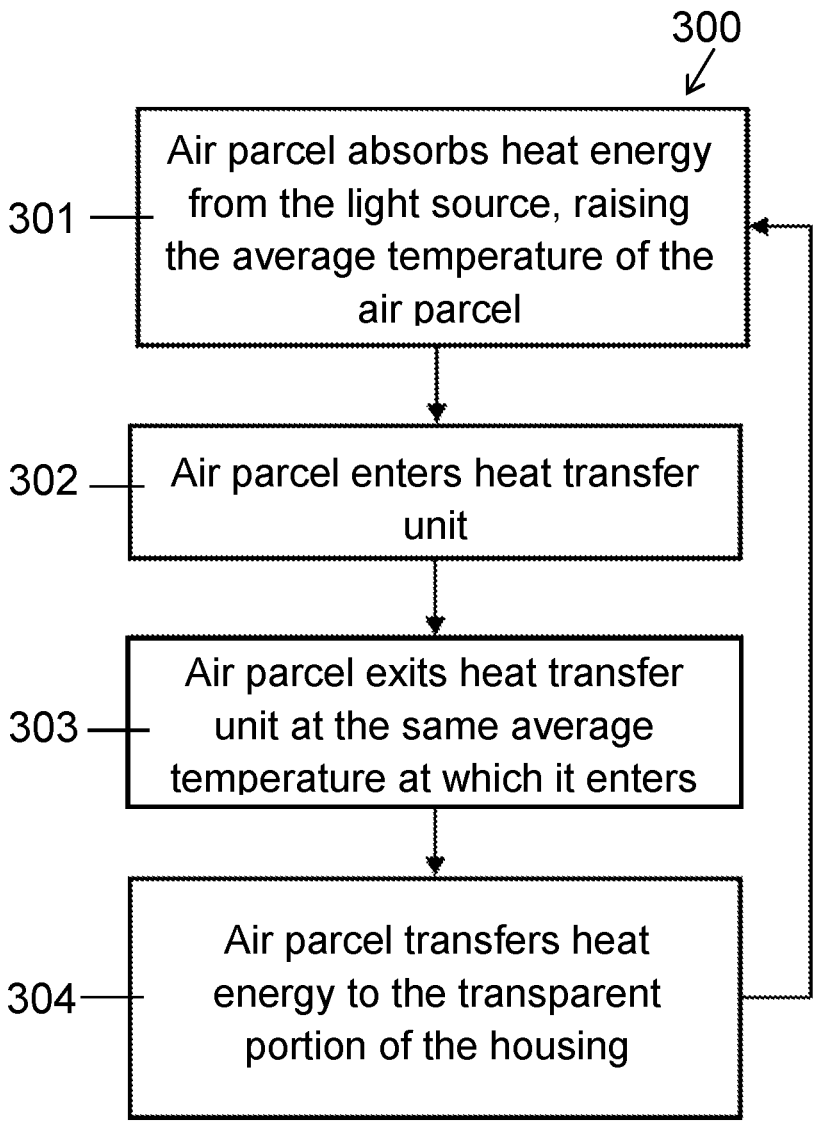
FIG. 4 is a flow chart illustrating the heat exchange process in a lamp according to the example in FIG. 2, with the heat transfer unit operating in the second mode.

In the example illustrated in FIG. 4, an air parcel absorbs heat energy from the light source (e.g. the light emitter and/or control electronics), raising the average temperature of the air parcel, step 301. The heated air parcel is then driven through the heat transfer unit 103 by the fan 106 (with the heater 105 turned off), step 302.

The fan 106 circulates the heated air parcel towards the transparent portion 101 of the housing. The heated air parcel then cools by transferring heat energy to the transparent portion 101, step 303. The air parcel may also be cooled by interacting with other parts of the housing 110, or other elements within the lamp 100 (e.g. the fan 106 or heater 105).

In some embodiments, the absorption of heat by the air parcel from the light source 102 may be enhanced by providing one or more heat sinks coupled to the light source (e.g. to the light emitter and/or any electronics coupled to the light emitter).

The example air flow paths shown in FIG. 2 may be biased towards operating the heat transfer unit 103 in the first mode, as an air parcel has a shorter distance to travel between the heater 105 and the transparent portion 101 of the housing than between the fan 106 and the light source 102. This may be advantageous as less heat energy may be lost from the air parcel through other unwanted interactions, resulting in a more efficient heating of the transparent portion 101.

Figure 5:
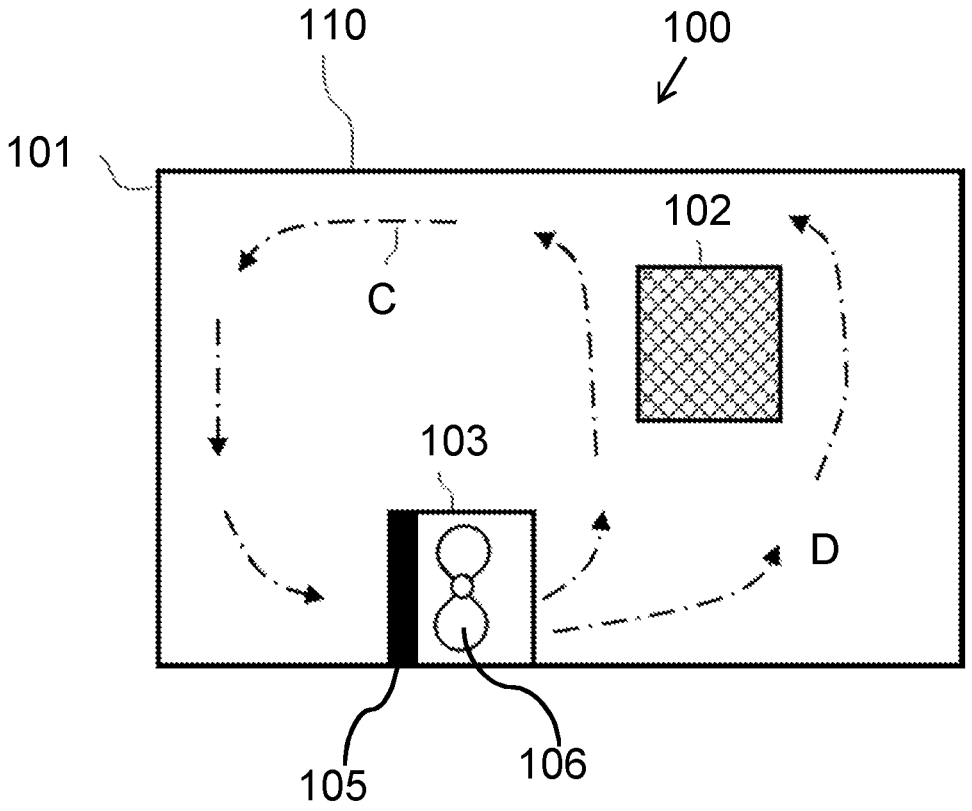
FIG. 5 is a schematic illustration of a different example air flow in the lamp of FIG. 1.

An example of a different possible air flow in the lamp of FIG. 1 is shown in FIG. 5. In this example, the fan 106 circulates air in the opposite direction compared with the example in FIG. 2.

In FIG. 5, the air within the housing 110 flows in the direction marked on paths C and D. The fan 106 circulates air from the heat transfer unit 103 to the light source 102, then to the transparent portion 101 of the housing, and back to the heat transfer unit 103.

Figure 6:
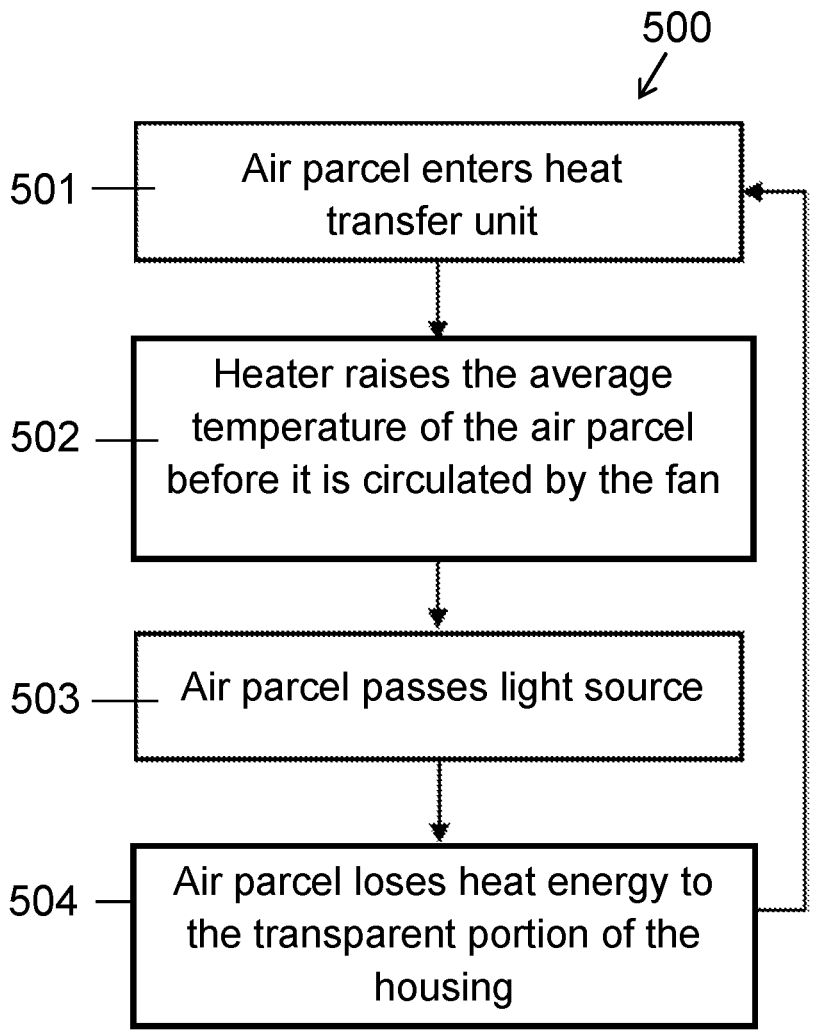
FIG. 6 is a flow chart illustrating the heat exchange process in the lamp according to the example in FIG. 5, with the heat transfer unit operating in the first mode.

In the first mode of operation (with the heater 105 and fan 106 turned on) an air parcel in the lamp 100 may undergo the heat exchange process 500 as described in FIG. 6.

In this example, an air parcel enters the heat transfer unit 103, step 501, and is heated by the heater 105 to raise its average temperature, step 502. The heated air parcel is then circulated by the fan 106 and passes the light source 102, step 503. The air parcel then loses heat energy to the transparent portion 101 of the housing, heating the transparent portion and decreasing the average temperature of the air parcel, step 504.

Other heat flows between the housing 110 and the air parcel, and/or the light source 102 (e.g. including the light emitter and/or the driver and/or control electronics) and the air parcel are also possible.

Figure 7:
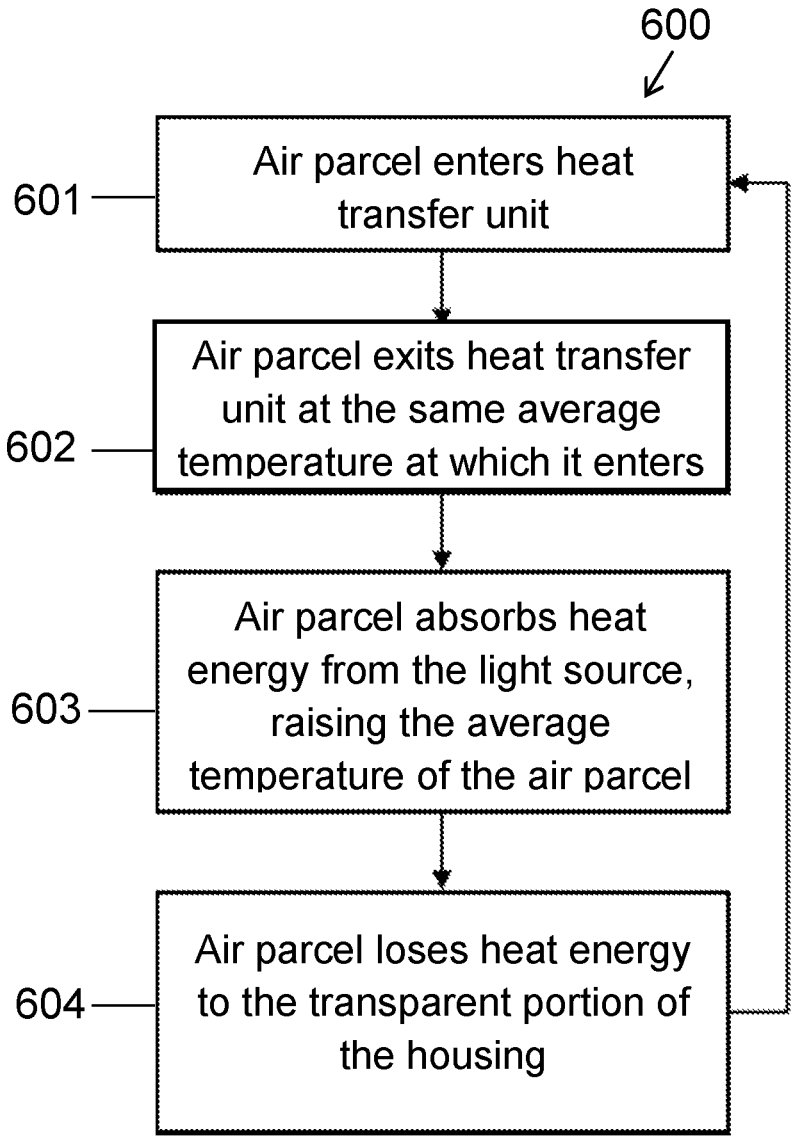
FIG. 7 is a flow chart illustrating the heat exchange process in the lamp according to the example in FIG. 5, with the heat transfer unit operating in the second mode.

In the second mode of operation, the heater 105 is switched off. A possible heat exchange process 600 for an air parcel within the lamp 100 is illustrated in FIG. 7.

The fan 106 drives an air parcel through the heat transfer unit 103, step 601. As the heater 105 is turned off, the average temperature of the air parcel as it exits the heat transfer unit is unchanged, step 602. The air parcel is then circulated towards the light source 102 by the fan 106 where it absorbs heat energy from the light source 102 (e.g. at least one of the light emitter and/or electronics), step 603. The heated air parcel then cools by transferring heat energy to the transparent portion 101 of the housing, step 604. The heated air parcel may also be cooled by interaction with other parts of the housing 110 or other components within the lamp 100 (see FIG. 1).

The air flow example shown in FIG. 5 provides an advantage compared to the example in FIG. 2 when the heat transfer unit 103 is operated in the second mode, as the air flowing through the fan 106 is at a lower average temperature (having transferred heat energy to the housing 110 before entering the fan 106). This may improve the functioning and lifetime of the fan 106.

In addition, the distance for an air parcel to travel from the fan 106 to the light source 102 is shorter in the example in FIG. 5 than in FIG. 2. In the second mode when the light source 102 needs to be cooled, it may therefore be easier for the fan 106 in FIG. 5 to control the air flow to the light source, thereby maximising the cooling of the light emitter and/or electronics.

As shown, there may be advantages in providing different air flow paths or directions when the heat transfer unit 103 operates in the first and second modes. Therefore, in some embodiments, the direction of operation of the fan 106 (or other fluid circulator) in the heat transfer unit 103 is reversible, so that the air (or other thermal transfer fluid) can be driven in two opposite directions.

For example, the fan 106 in FIG. 1 may be operable to circulate air in the direction shown in FIG. 2 when operating the heat transfer unit 103 in the first mode, and the direction shown in FIG. 5 when operating in the second mode. Thus, the air flow path may be optimised for the function of the heat transfer unit 103, providing the benefits of both of these paths discussed above.

In some embodiments, this can be achieved by changing the direction of rotation of the fan 106, for example by reversing the polarity of an electric current applied to the fan 106.

The heater 105 in FIG. 1 may comprise one or more resistance wire heating elements. A resistance wire heating element heats up by the process of Joule heating when an electrical current passes through the resistance wire heating element. The resistance wire heating element may comprise a wire comprising at least one of the following: nickel, copper, nickel-chromium, nickel-iron, copper-nickel, copper-manganese-nickel, iron-chromium-aluminium, molybdenum disulphide, silicon carbide.

Additionally or alternatively, the heater 105 may comprise a hot plate, a ceramic heating element, and/or an infrared bulb. The heater 105 may comprise a heat exchanger in which heat is transferred, in use, from a higher temperature fluid to the air (or other thermal transfer fluid) within the housing.

In some embodiments, the heater 105 may comprise a resistance wire heating element which is only supported along part of its length. This may result in the air flow passing through and around the resistance wire heating element in the unsupported area(s), thereby facilitating heating of the air.

The heater 105 may be positioned within the heat transfer unit 103 to ensure that air passes through the heater 105 before passing through the fan 106. In other embodiments or modes of operation, the heater 105 may be positioned so that air passes through the heater 105 after passing through the fan 106.

Figure 8A:
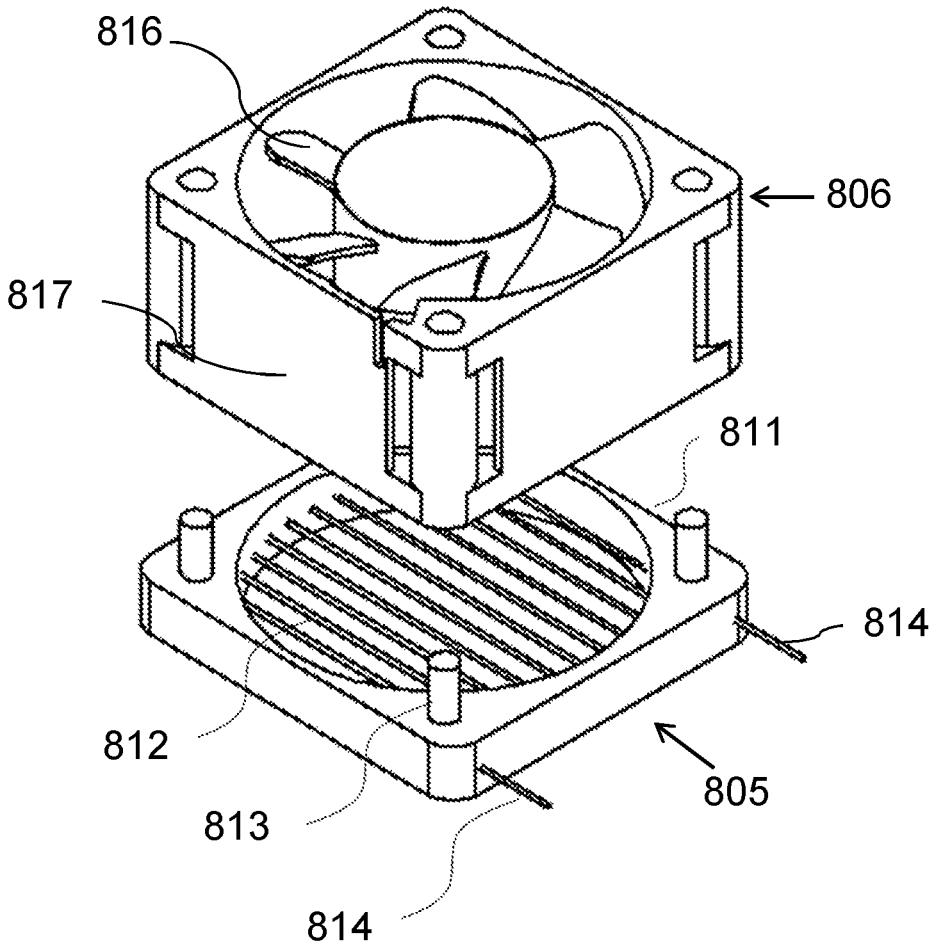
FIG. 8A shows an exploded view of a heat transfer unit according to an embodiment of the invention.
Figure 8B:
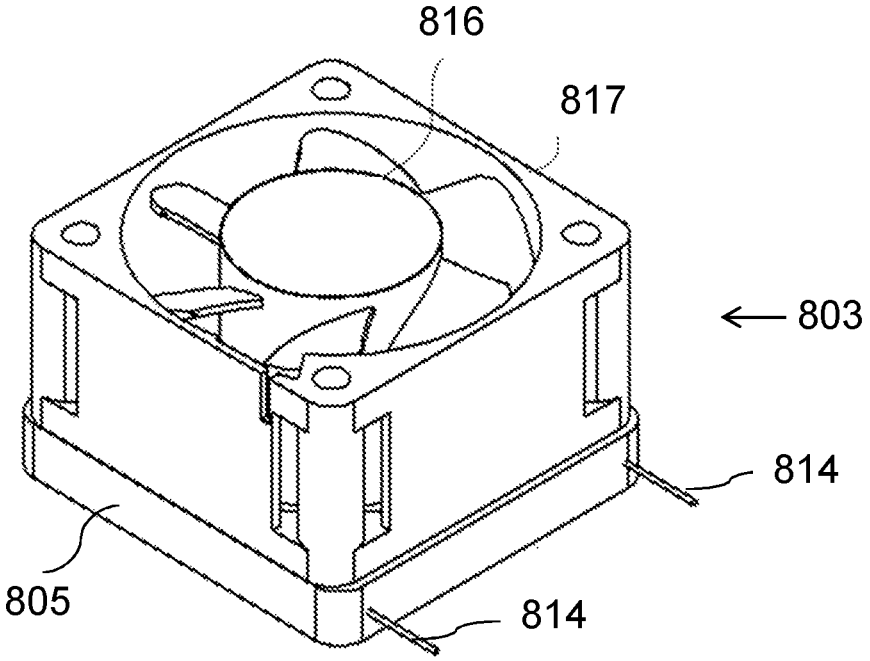
FIG. 8B shows a perspective of the heat transfer unit of FIG. 8A in assembled form.
Figure 8C:
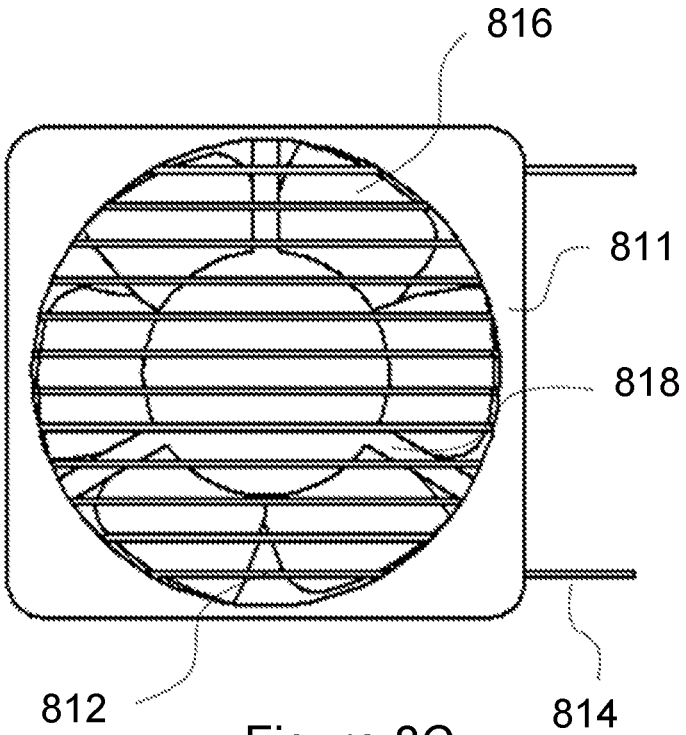
FIG. 8C shows an end-on view of the heat transfer unit of FIG. 8.

An example of a heat transfer unit of the present invention is shown FIGS. 8A-8C. FIG. 8A shows the heat transfer unit 803 in an exploded view, to more clearly illustrate the component parts and construction of the unit. FIG. 8B shows a perspective view of the heat transfer unit 803 in assembled form and FIG. 8C shown an end-on view of the assembled heat transfer unit 803.

The heat transfer unit 803 comprises a fan 806 and a heater 805. The fan 806 comprises a fan housing 817 and fan blades 816. The heater 805 comprises a heater housing 811 and a resistance wire heating element 812. The resistance wire heating element 812 is arranged such that it extends back and forth across a central aperture passing through the heater housing 811. The resistance wire heating element is coupled to the heater housing 811, and is unsupported along the portions of its length, which extend across the central aperture.

The heater housing 811 includes one or more attachment means 813 to connect the heater housing 811 to the fan housing 817. The heater 805 includes electrical inputs and outputs 814 (e.g. to provide a power supply to the resistance wire heating element 812).

When the heater housing 811 is connected to the fan housing 817, the aperture across which the resistance wire heating element 812 extends back and forth is axially aligned with the fan 806. Such an arrangement may provide efficient heating of the thermal transfer fluid (e.g. air) circulated, in use, by operation of the fan.

In FIG. 8C the fan blades 816 can rotate, in use about an axis perpendicular to the page. Any significant translational movement of the fan blades 816 is prevented by the fan frame 818, which is connected to the fan housing 817. In this embodiment, the rotation of the fan blades 816 drives air flow through the fan housing 817, so that this airflow passes through the unsupported area of the resistance wire heating element 812.

The resistance wire heating element 812 is not restricted to the arrangement illustrated in FIGS. 8A and 8C. A wide range of arrangements may be suitable, including grid- or grill-like arrangements, arrangements in which the wire lies in more than one plane (e.g. a spiral or helical arrangement) and/or crosses itself.

In some embodiments, the resistance wire heating element may be formed in a spiral or coil pattern. For example, the resistance wire heating element may be coiled around a support, which may aid assembly. The axis of the coil may be substantially perpendicular to the average or principal direction of fluid flow through the resistance wire heating element. Such an arrangement may allow a longer resistance wire heating element to be included. This may allow operation of the resistance wire heating element at a lower temperature, thereby allowing a wider selection of materials and assembly methods to be utilised.

In some embodiments, the parts of the resistance wire heater which could impede the fluid flow may have a shape which is substantially circular or spiral shaped. Such shapes may minimise back pressure on the fluid circulator, for example if the fluid circulator is a fan (such as fan 806) any interaction with the fan vortex may be reduced.

Figure 9:
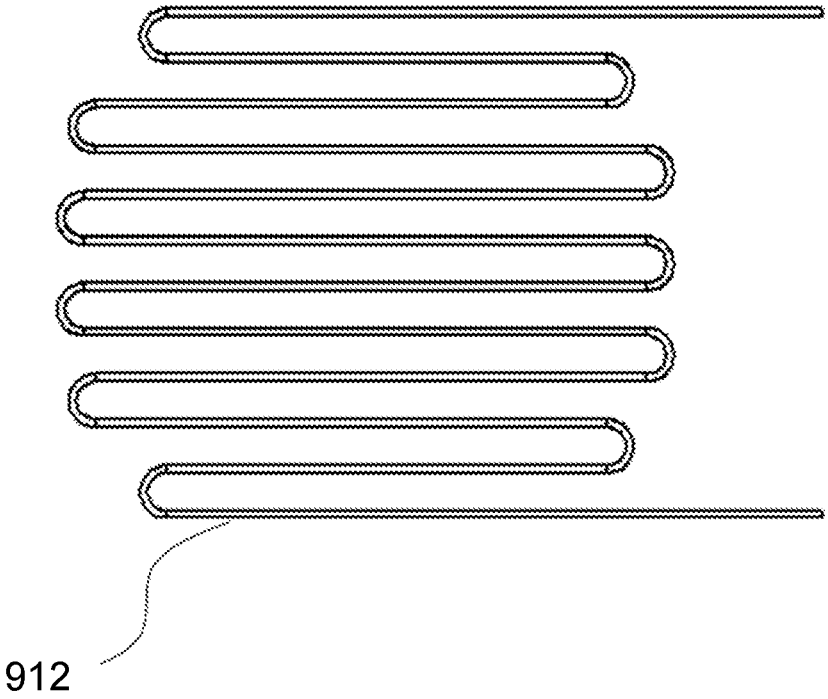
FIG. 9 shows another example of a resistance wire heating element for use in a heat transfer unit according to the invention.

In some embodiments, the resistance wire heating element 812 may be formed of a single resistance wire, formed into a serpentine pattern, as shown in FIG. 9.

In an embodiment, the heater may comprise more than one resistance wire heating element. Each resistance wire heating element may be controllable independently.

Figure 10:
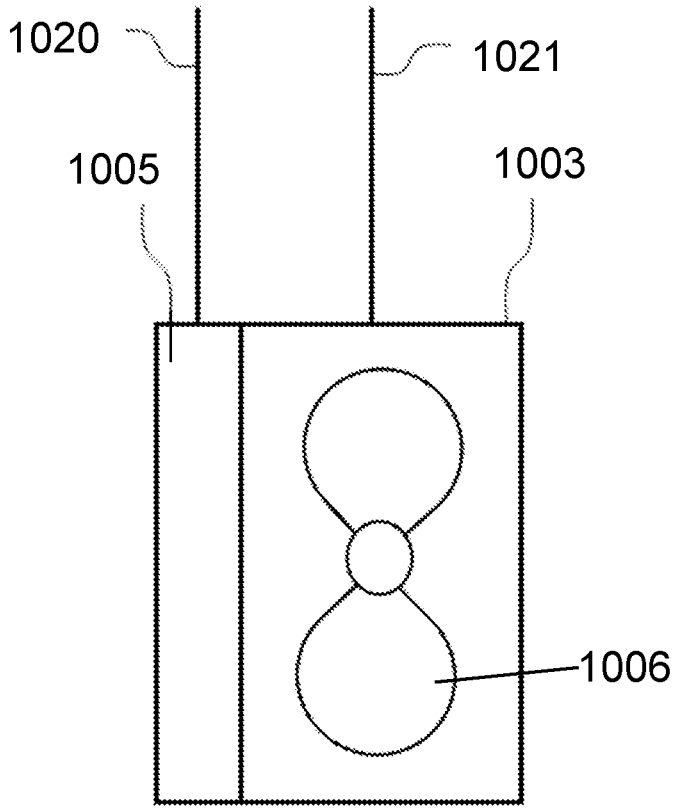
FIG. 10 illustrates a schematic example of a heat transfer unit according to a further embodiment of the invention.

In some embodiments of the heat transfer unit, the fan and heater element may be separately electrically controlled, as shown in FIG. 10. The heat transfer unit 1003 comprises a heater 1005 and a fan 1006. There is provided an electrical control line for the fan 1021 and a separate electrical control line for the heater 1020.

An advantage of using separate electrical control lines is that the fan 1006 and heater 1005 can be manufactured separately before being assembled into the heat transfer unit 1003. This may save manufacturing costs and allow heaters and fans (or other fluid circulators) from different manufacturers to be combined into the heat transfer unit of the present invention.

In some embodiments, the heater 1005 may be retrofitted to an existing lamp (such as a vehicle headlamp) which has a fluid circulator such as a fan already installed therein. The pre-installed fluid circulator may then be used either as part of a heat transfer unit 1003.

In some embodiments, the heat transfer unit 1003 may be installed into an existing lamp. If the lamp already comprises a fan, this may be incorporated into the heat transfer unit 1003 or used as a separate standalone fan, thereby increasing the circulation of air flow within the lamp which may result in an improved cooling and/or heating process.

Similarly, a fluid circulator may be retrofitted in to a lamp, which has a heater already installed therein, in order to provide a lamp according to the invention.

In some embodiments, the heat transfer unit 1003 may be controlled by an electronic controller (not shown). For example, the electronic controller may provide at least one output to the fluid circulator 1006 and/or heater 1005, providing control over at least one of the direction or speed of the fluid circulator 1006 or the heater 1005 power. The electronic controller may in turn be controlled via a wireless or wired communication or data link such as a Controller Area Network (CAN) bus or Local Interconnect Network (LIN).

The electronic controller may be separate from the heat transfer unit 1003, or the electronic controller may be integrated into the heat transfer unit 1003.

While the present invention has been disclosed with reference to certain exemplary embodiments, many modifications may be apparent to the person skilled in the art without departing from the scope of the invention.

The invention claimed is:

1. A heat transfer unit for use in a lamp, the lamp comprising: a housing having a transparent portion and a light source disposed at least partially within the housing, wherein the light source is configured to emit light, in use, through the transparent portion of the housing, wherein the heat transfer unit is adapted to be disposable at least partially within the housing and the heat transfer unit comprises a heater and a fluid circulator, wherein the heat transfer unit is operable in a first mode and a second mode; wherein in the first mode, the heater is turned on, thereby heating a thermal transfer fluid contained within the housing, and the fluid circulator is operated to circulate the thermal transfer fluid such that heat is transferred to the transparent portion of the housing; and in the second mode, the heater is turned off, and the fluid circulator is operated to circulate the thermal transfer fluid contained within the housing such that heat is transferred away from the light source to the transparent portion of the housing:

wherein the fluid circulator is operable to circulate the thermal transfer fluid in two or more directions and wherein the fluid circulator is operable to circulate the thermal transfer fluid in different directions when operating in the first and second modes.

2. The heat transfer unit according to claim 1 further comprising a controller operable to control the heat transfer unit, wherein the controller provides at least one output to the fluid circulator and/or the heater, thereby providing control over at least one of the direction and/or speed of the fluid circulator and/or the heater power.

3. The heat transfer unit according to claim 1, wherein the mode of operation of the heat transfer unit is selectable, in use, by a user.

4. The heat transfer unit according to claim 1, wherein the fluid circulator comprises one or more of a mechanically or electrically operated fan, pump or compressor.

5. The heat transfer unit according to claim 1, wherein the heater comprises one or more of: at least one resistance wire heating element, a hot plate, a ceramic heating element, an infrared bulb, and/or a heat exchanger, in which heat is transferred, in use from a higher temperature fluid to the thermal transfer fluid within the housing.

6. A lamp comprising: a housing having a transparent portion; a light source disposed at least partially within the housing, wherein the light source is configured to emit light, in use, through the transparent portion of the housing; and the heat transfer unit according to claim 1 disposed at least partially within the housing.

7. The lamp according to claim 6, wherein the light source includes a light emitter and electronics coupled to the light emitter, and/or wherein the light source is operable to emit visible light and/or ultraviolet radiation and/or infrared radiation, and/or wherein the light source comprises one or more light emitting diodes (LEDs).

8. The lamp according to claim 6, wherein one or more heat sinks is/are coupled to the light source or a part thereof to transfer any waste heat to the thermal transfer fluid.

9. The lamp according to claim 6, wherein the thermal transfer fluid is air.

10. The lamp according to claim 6, wherein there is fluid communication between the inside of the housing and the external environment.

11. The lamp according to claim 6, comprising at least one sensor operable to detect one or more of: the amount of time the lamp has been switched on; the ambient temperature external to the lamp; the temperature within the housing; the temperature of the light source within the housing; and/or the amount of moisture on the transparent portion of the housing.

12. The lamp according to claim 6, wherein the heat transfer unit operates in the first mode when: the lamp is initially turned on; and/or the ambient temperature external to the lamp is below a predetermined threshold; and/or the amount of moisture on the transparent portion of the housing is above a predetermined threshold, and/or wherein the heat transfer unit operates in the second mode when: the lamp has been turned on for a set amount of time; and/or the temperature of the light source within the housing is above a predetermined threshold; and/or the ambient temperature external to the lamp is above a predetermined threshold; and/or the amount of moisture on the transparent portion of the housing is below a predetermined threshold.

13. The lamp according to claim 6, wherein the predetermined threshold(s) are set and/or adjusted by a user, and/or wherein the predetermined threshold(s) is/are determined by a processor dependent, for example, on the application of the lamp and/or the type of light source.

14. The lamp according to claim 6, wherein the heat transfer unit is positioned out of the optical path between the light source and the transparent portion of the housing.

15. The lamp according to claim 6, wherein the lamp is a vehicle lamp.

16. A structure comprising, carrying or having associated therewith a lamp according to claim 6, optionally wherein the structure is a vehicle or a stationary structure.

17. A vehicle according to claim 16, further comprising at least one sensor operable to measure the amount of time that the vehicle has been turned on, and/or wherein the heat transfer unit operates in the second mode when the vehicle has been turned on for a set amount of time.

18. A kit of parts for assembly into a lamp according to claim 6, the kit of parts comprising:

a housing having a transparent portion;

a light source disposable at least partially within the housing and configurable to emit light, in use, through the transparent portion of the housing; and a heat transfer unit disposable at least partially within the housing, the heat transfer unit comprising a heater and a fluid circulator, wherein the heat transfer unit is operable in a first mode and a second mode; wherein in the first mode, the heater is turned on, thereby heating a thermal transfer fluid contained within the housing, and the fluid circulator is operated to circulate the thermal transfer fluid such that heat is transferred to the transparent portion of the housing; and in the second mode, the heater is turned off, and the fluid circulator is operated to circulate the thermal transfer fluid contained within the housing such that heat is transferred away from the light source to the transparent portion of the housing:

wherein the fluid circulator is operable to circulate the thermal transfer fluid in two or more directions and wherein the fluid circulator is operable to circulate the thermal transfer fluid in different directions when operating in the first and second modes.

* * * * *